United States Patent [19]

Ruhl et al.

[11] 4,295,797

[45] Oct. 20, 1981

[54] FUEL SUPPLY PUMP

[75] Inventors: Karl Ruhl, Gerlingen; Ulrich Kemmner, Sachsenheim, both of Fed. Rep. of Germany

[73] Assignee: Robert Bosch GmbH, Stuttgart, Fed. Rep. of Germany

[21] Appl. No.: 103,775

[22] Filed: Dec. 14, 1979

Related U.S. Application Data

[63] Continuation of Ser. No. 932,388, Aug. 9, 1978, abandoned.

[30] Foreign Application Priority Data

Oct. 12, 1977 [DE] Fed. Rep. of Germany ..... 2745818

[51] Int. Cl.[3] ..... F02M 37/08; F04B 23/14; F04B 17/00

[52] U.S. Cl. ..... 417/203; 417/205; 417/368; 417/420

[58] Field of Search ..... 417/420, 203, 205, 366, 417/247, 244, 423 R

[56] References Cited

U.S. PATENT DOCUMENTS

| | | | |
|---|---|---|---|
| 2,055,587 | 9/1936 | Pigott | 417/203 |
| 3,873,243 | 3/1975 | Nusser et al. | 417/368 |
| 3,897,179 | 7/1975 | Fussner et al. | 417/366 X |
| 4,111,614 | 9/1978 | Martin | 417/420 |
| 4,120,618 | 10/1978 | Klaus | 417/420 |

*Primary Examiner*—Richard E. Gluck
*Attorney, Agent, or Firm*—Edwin E. Greigg

[57] ABSTRACT

A fuel supply pump is proposed where the pumping system comprises two individual pumping stages connected in seriatim and are both driven by the motor armature of an electromotor located in a common housing, and further where the drive of the pumping stage adjacent to the electromotor is accomplished by means of a contactless coupling assembly including permanent magnets fixed in the hub areas of the rotating parts of the adjacently disposed pumping stages. In a further preferred embodiment of the invention the permanent magnets are operatively associated by being in radial alignment but not in contact with each other and are separated in a pressure-tight manner by means of a rigid flange-like element inside the housing of the fuel supply assembly.

13 Claims, 1 Drawing Figure

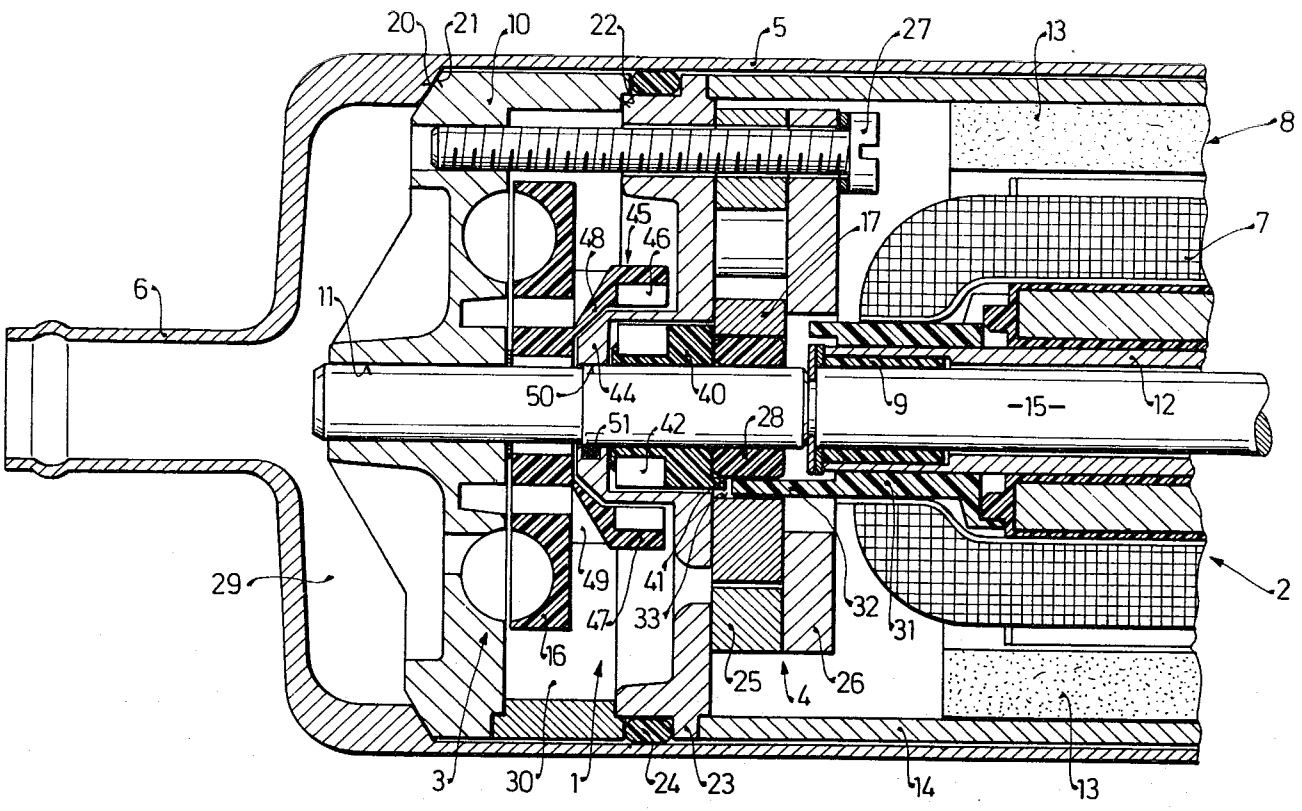
8
7
2
13
12
15
13
27
9
31
14
17
32
26
5
28
4
25
40
23
42
41
33
24
22
45
46
44
51
48
49
47
1
50
16
30
10
21
3
20
11
29
6

FUEL SUPPLY PUMP

This is a continuation of application Ser. No. 932,388, filed Aug. 9, 1978, now abandoned.

BACKGROUND OF THE INVENTION

The invention relates to a fuel supply pump of the type generally disclosed in our earlier U.S. Pat. No. 4,205,947 and assigned to the assignee of this application. Fuel supply pumps have already been proposed which have a pumping system comprising a first supply pump and a main supply pump connected in seriatim which is driven as a whole by a common electromotor. With these known fuel supply pumps, there are difficulties associated with trying to achieve a trouble-free coupling between the two pumping stages, without the moving parts of both pumping stages, through their separate motion, influencing each other too strongly. In this respect it is of particular importance that a trouble-free sealing off of the pumping stages from each other be accomplished in the area of the bearing of the rotating parts, that is, a sealing off of the high pressure space from the medium pressure space.

OBJECT AND SUMMARY OF THE INVENTION

The fuel supply pump according to the invention overcomes the difficulties associated with the known structures and has the advantage that the movable part of the pumping stage which is located at a distance from the electromotor (that is, not the pump which is in close proximity to the electromotor) is coupled without difficulty and without reciprocal disturbances of the individual pumping stages and their work capacities. Also, it is further of particular advantage that a trouble-free sealing can be effected between the individual pumping stages which is not based on a sealing means subordinate to a rotary movement but is rather obtained by a stationary structural part.

Since the rotating parts of both pumping stages are not connected directly in a mechanical manner, but instead the rotary coupling takes place without contact, all the possible influences which one pumping stage could exert upon the other are precluded. The invention accomplishes a trouble-free balance of expansion of structural elements located in the area of the pumping stages or making up the pumping stages.

As a result of worsening fuel quality, functional disturbances of the supply pump, such as the conventionally employed roller piston pump, can occur at a higher rate while fuel is being supplied at an elevated temperature. This may be prevented by supplying the fuel at a small overpressure, since by this means an extreme increase in vapor formation can be avoided as a cause of pumping deficiency. The production of the supply pressure can be assumed by a hydrodynamic pump which has ventilation capabilities. This pump is either connected in series as a separate electro-fuel pump or, in accordance with the present invention, integrated into the roller piston pump as a first stage. In the case of the integrated two-stage pump, the torque transfer is significant as it takes place from the motor armature to the groove disc of the roller piston pump and from there to the impeller of the lateral channel pump, which is conventionally employed as a first-stage pump; and the sealing between these two individual pumping stages, which have varying overpressure levels, is also significant.

Another advantage of this invention is to provide an intermediate flange element which is suitably apertured and arranged to receive the shaft carried by the electromotor. This flange element also functions as one portion of the support means for the pumps that are disposed on opposite sides thereof.

A further advantage of this invention is to utilize the intermediate flange element as a divider member for separating a high pressure pumping area from a medium pressure area.

The invention will be better understood as well as further objects and advantages thereof become more apparent from the ensuing detailed description of a preferred embodiment taken in conjunction with the drawing.

BRIEF DESCRIPTION OF THE DRAWING

The single FIGURE of the drawing shows a partial longitudinal section through a preferred embodiment of a fuel supply pump according to the present invention.

DESCRIPTION OF THE PREFERRED EMBODIMENT

The fuel supply pump represented in the drawing comprises a pumping area 1, which includes the two pumping stages and the electromotor 2 driving both pumping stages. The two pumping stages (that is, the lateral channel pump selected as a first supply pump and the roller piston pump which operates as the main supply pump) as well as the electromotor 2 are enclosed in a cup-shaped housing 5, which with the electromotor 2 and the entire right-hand part of the pump in the plane of the drawing is only partially shown. The housing 5 has an intake connection 6 on its lower end, onto which a fuel conduit, not shown, can be attached. The cup-shaped housing is closed on the right-hand side by means of a cap, not shown, which can be secured at the open end of the housing by a customary flange means.

In the interior of the housing, as viewed from the intake to the pressure side, first the two pumps 3 and 4 and then the electromotor 2 are arranged; the fuel supplied under pressure also flows through the electromotor 2 and its structural elements in order to cool them.

The drawing comprises only the parts which are required for understanding the invention; thus the electromotor is shown only in part and reference may be made to our earlier application for a more comprehensive view of an electromotor structure of this type. Devices of this type include a rotating motor armature 7 and a magnet part 8. The motor armature 7 is fixed on a rigid shaft 15, which is firmly pressed into a stationary bearing part in the front area of the housing, by means of appropriate bearings, for example journal bearings 9. In the illustrated exemplary embodiment the first supply pump 3 as a lateral channel pump has a base plate 10 with a central bore 11, into which the shaft 15 is pressed. The other end of the shaft can be supported by an appropriate bore of a cap, which is not shown.

The bushings 9 which fix the motor armature 7 on the shaft 15 are arranged in a bearing tube 12, on which the laminar packet and the core winding are located. The collector area of the electromotor 2 is not shown.

The magnet part 8 of the electromotor 2 comprises two permanent magnets 13, which are arranged in a tubular or cylindrical holding part 14 made of magnetically conductive material. The holding part 14 serves at the same time to clamp the individual structural elements in the pumping area 1, since the cap, not shown, exerts a corresponding clamping pressure on the holding part.

In the exemplary embodiment shown, as has already been noted, the first pumping stage directly associated with the intake connection 6 is a lateral channel pump 3, while the second pumping stage connected at the outlet side of the lateral channel pump is a roller piston pump 4. However, the type and design per se of these pumps can of course be arbitrary; thus each stage can be embodied as a fluid pump in general, such as a centrifugal pump, lateral channel pump, geared pump, roller piston pump, or any other kind, while with two compressor pumps coupled in series and lacking a self-regulating feature, a pressure-regulating member must be connected between them. It is essential only that a rotary coupling take place between the various moving parts of each pump (for example between the pump impellers or, in the present exemplary embodiment, between the impeller 16 of the lateral channel pump 3 and the groove disc 17 of the roller piston pump 4) which precludes any further mutual influence between the pumping stages, and that the pumping stages are appropriately sealed off from each other.

The design of the pumping stages employed in the exemplary embodiment is such that, proceeding from the intake connection 6 in the housing 5, there is first the base plate 10 of the lateral channel pump 3, which is supported at an oblique seating surface 20 by a correspondingly oblique circular bearing surface 21 of the housing. The base plate 10, on its side facing the impeller 16 also includes the stationary part of the lateral channel pump 3 which is operationally connected with the impeller 16. It is not believed to be necessary to go into great detail concerning the special design and operation of the two pumping stages employed, since such fluid pumps as described herein are of themselves already known.

A stationary intermediate flange 23 has an annular undercut area into which a sealing means 24 is seated and arranged to project without play into a suitable shoulder means 22 of the front base plate 10 to which the intermediate flange 23 effects a reliable sealing off of the high pressure space from the medium pressure space and at the same time forms the intake plate of the roller piston pump 4 that is mounted adjacent thereto. There is an additional plate 25 arranged axially of and in abutment with the intermediate flange 23 and adjacent thereto is provided a support plate 26 which forms an enclosure of the roller piston pump. The intermediate flange 23, together with the additional plate 25 and support plate 26 encompasses among them the groove disc 17 of the roller piston pump, which is fixed by means of a suitable bearing 28 on the rigid shaft 15. The intake side of the lateral channel pump 3 adjoins an intake space 29 that communicates with the intake connection 6 while the pressure side thereof communicates with an intermediate pressure space or medium pressure space 30, which opens to the intake side of the proximate roller piston pump 4, and its pressure side in turn opens into the space which leads to the electromotor 2.

A sleeve or bushing 31 is arranged on the shaft 15 on the side that confronts the roller piston pump 4 and engages by means of at least one drive spline 32 through a central opening in the support plate 26 with a corresponding recess 33 in the groove disc 17, to form the rotary coupling. In this way, the rotary coupling of the pump rotor of the roller piston pump 4 begins at the electromotor. Of course this coupling can also take place in an arbitrary manner, for example with the bearing tube omitted and the shaft itself being rotatably fixed in bearings and thus directly bearing the motor armature.

The torque transfer from the groove disc 17 of the main supply pump (roller piston pump 4) onto the impeller 16 of the first supply pump 3 takes place without contact, so that mechanical influences and the irregularities that might result therefrom have no effect on the rotary coupling of the two pumping stages. In general, the groove disc 17 of the roller piston pump 4 has permanent magnet parts fixed in its side facing the impeller 16 of the lateral channel pump. These lines of force enter into an operational relationship with permanent magnet parts which face them on the associated side of the impeller 16 of the lateral channel pump 3 in such a manner that a rotary coupling is effected, all of which will be better understood as this description progresses. The magnetic lines of force thereby penetrate as well as the intermediate flange located between the two rotating parts of the pumps, which is formed of a magnetically non-conductive material.

In the illustrated exemplary embodiment, the pump is constructed in such a way that the torque is transferred from the groove disc 17 to a hub portion 40 which rotates therewith. The hub portion 40 can be a plastic part, which has a cylindrical configuration and is rotatably fixed on the shaft 15 and includes an extension 41 which can project into recess 33 of the groove disc 17 into which the coupler nose 32, driven by the motor armature 7, is also arranged to project. However, the plastic coupler part 40 can also be embodied in one piece with the groove disc 17, for example, by being spray-molded thereon or communicating with the groove disc in any arbitrary manner. The plastic coupler part 40, which surrounds the shaft 15, forms a hub-like protuberance having the permanent magnets on its outer rim, which in the present embodiment comprises a magnet ring 42, as shown. The magnet ring can have north and south poles distributed in alternating order on its circumference. A pressure-tight cover cap 44 integral with intermediate flange 23 forms a shroud over the rotating, hub-like proturberance which has the inlaid magnet ring and is formed by the plastic coupler part 40. This cover cap 44 is made of a nonmagnetic material, is immovable by reason of being an integral component of the intermediate flange 23, the function of which was discussed earlier herein.

Surrounding this cover cap 44 of the intermediate flange 23 there is another hub portion 45 that may be integral with the impeller 16 of the lateral channel pump 3 and that may serve as a complementary bearing part for the impeller 16. This element may be preferably spray-molded on in one piece to thereby form a kind of hood over the cover cap 44. The bearing part 45 encircles the magnet ring area of the plastic coupler 40 at a radial distance and also includes magnet parts, preferably an inlaid magnet ring 46, which is therefore in axial and radial alignment with the magnet ring 42. The ring area 47 of the bearing part 45 which has the inlaid magnet ring 46 is associated with the impeller 16 of the lateral channel pump via a truncated cone 48 which extends obliquely toward the intermediate flange 23. The bearing part 45 can also be provided with radially extending ribs as denoted at 45.

A particular characteristic of the present invention is that the intermediate flange 2, with its shroud-like proturberance forms the cover cap 44, is pressed onto the shaft 15; that is, a central bore 50 of the cover cap 44 is press-fitted on the shaft 15, with the interposition, when required, of a sealing means which is indicated as reference numeral 51. Thus, as may be seen, a reliable seal is produced between the high pressure and the medium pressure spaces of the pump mechanism, as well as an equally reliable rotary coupling of the rotating parts of the two pumps which precludes any mutual mechanical influence between them aside from the rotary coupling, and finally a comparatively simple and inexpensive pump design, since all the pump structural elements comprising the pumping area 1 can be clamped together and adjusted before their insertion into the housing 5.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. In a fuel supply pumping system arranged together with a driving electromotor in a common housing, said system including a first pumping stage, a second pumping stage, a first rotary coupling connection between said first and second pumping stages, and a second rotary coupling connection between said electromotor and one of said pumping stages, the improvement wherein said first rotary coupling includes oppositely extending hub portions, each hub portion being provided with a permanent magnet element, said permanent magnet elements together forming a magnetic coupling.

2. A fuel supply pumping system as claimed in claim 1, wherein at least one of said pumping stages includes an intermediate flange element and said intermediate flange element includes a member that projects between said hub portions.

3. A fuel supply pumping system as claimed in claim 2, wherein one of said pumping stages includes a pumping element that is arranged to support one of said hub portions.

4. A fuel supply pumping system as claimed in claim 2, wherein one of said hub portions is mounted on a shaft that extends through said electromotor and said intermediate flange element.

5. A fuel supply pumping system as claimed in claim 4, wherein said member of said intermediate flange element is embodied as a cover cap forming a shroud over said one of said hub portions, and wherein said one of said hub portions is freely rotatable on said shaft.

6. A fuel supply pumping system as claimed in claim 5, wherein said one of said hub portions comprises a plastic body.

7. A fuel supply pumping system as claimed in claim 2, wherein said member is further formed as an extension of said intermediate flange, said extension of said intermediate flange being press-fitted to a shaft that extends through said electromotor.

8. A fuel supply pumping system as claimed in claim 1, wherein said permanent magnet elements in each said hub portion are axially and radially aligned.

9. A fuel supply pumping system as claimed in claim 3, wherein said one of said hub portions is spray-molded to said pumping element.

10. A fuel supply pumping system as claimed in claim 3, wherein said one of said hub portions comprises a channel area arranged to support its permanent magnet element, said one of said hub portions being connected to said pumping element by a truncated conical portion.

11. A fuel supply pumping system as claimed in claim 1, wherein said first pumping stage is embodied as a lateral channel pump and said second pumping stage is embodied as a roller piston pump.

12. A fuel supply system as claimed in claim 11, wherein one of said hub portions is coupled with a rotating element of said roller piston pump for rotation therewith.

13. A fuel supply pumping system as claimed in claim 11, wherein said lateral channel pump includes a base plate which is affixed to a shaft supporting said electromotor and a means arranged in abutting relation with said roller piston pump includes further means for supporting each of said pumping stages in assembled relation.

* * * * *